United States Patent [19]

Clemison

[11] 3,998,421

[45] Dec. 21, 1976

[54] AUXILIARY HOLDER

[76] Inventor: Arden L. Clemison, 1452 W. 183rd St., Gardena, Calif. 90248

[22] Filed: Jan. 30, 1976

[21] Appl. No.: 653,812

[52] U.S. Cl. ..... 248/441 B; 403/4

[51] Int. Cl.[2] ..... A47B 97/04

[58] Field of Search ..... 248/226 E, 298, 287, 248/441 B, 441 C; 403/4

[56] References Cited

UNITED STATES PATENTS

| | | | |
|---|---|---|---|
| 155,202 | 9/1874 | Nutting | 248/441 C X |
| 454,553 | 6/1891 | Whitten | 248/441 C UX |
| 758,924 | 5/1904 | Law | 248/441 C X |
| 1,821,060 | 9/1931 | Isaacson | 248/441 C X |
| 2,015,280 | 9/1935 | Morishita | 248/441 C X |
| 2,359,895 | 10/1944 | Burton | 248/441 C X |
| 2,547,239 | 4/1951 | Walker | 248/226 E X |
| 2,668,744 | 2/1954 | Cockrell | 248/298 X |
| 2,778,588 | 1/1957 | Capocci | 248/112 |
| 3,799,487 | 3/1974 | Durrant | 248/441 C |

FOREIGN PATENTS OR APPLICATIONS

| | | | |
|---|---|---|---|
| 4,242 | 10/1891 | Switzerland | 403/4 |

*Primary Examiner*—William H. Schultz
*Attorney, Agent, or Firm*—Harry R. Lubcke

[57] ABSTRACT

An adjustable holder for an auxiliary article related to an artist's easel, as a sketch being copies by the artist. A first rod attaches to the easel and extends horizontally therefrom. A second rod attaches to the first rod and extends vertically therefrom. A cross-member at the upper extremity of the second rod supports the sketch.

9 Claims, 3 Drawing Figures

AUXILIARY HOLDER

BACKGROUND OF THE INVENTION

This invention pertains to an adjustable support device.

The easel employed by artists to support their canvas at a convenient angle and position for painting is well known, as is the easel employed for supporting signs in hotel lobbies and at similar locations.

At times such as easel has been combined with other instrumentalities for the convenience of the artist, or for exhibiting more than one display upon one support structure.

One embodiment of the latter type employs essentially an all-rod frame with a removable rear support for exhibiting two displays in either a self-supporting manner, or hanging from a wall.

Another embodiment, being of the former type, includes a drawer for holding artists's materials, or the like.

An early arrangement that employed rods and clamps to support a book from the seat of a chair, or equivalent, is also known, but the clamping means are involved and are expensive to manufacture.

SUMMARY OF THE INVENTION

An adjustable holder for an auxiliary article spaced from an easel. An attachment to the easel is suited to selectively hold the auxiliary article to the left or the right of the easel. A horizontal rod spaces the holder away from the easel. A vertical rod at the extremity of the horizontal rod elevates the auxiliary article to a convenient viewing height. A cross-member at the upper extremity of the vertical rod supports the auxiliary article. The holder has adjustments to vary the relative positions of the article and the easel in two dimensions and also as to the inclination of the article.

DESCRIPTION OF THE PREFERRED EMBODIMENT

Figure 1:
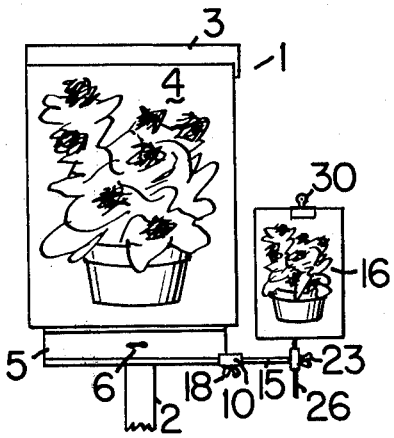
FIG. 1 shows the invention in use in a front elevation of an easel and the attachment.

In FIG. 1, numeral 1 generally indicates an artist's easel. In these days such as easel is typically comprised of a central vertical aluminum structural-shape standard 2. This rests upon an adequate base that has not been shown. It is surmounted by a horizontal member, say of plywood, which is identified by numeral 3. This is one of the support members for the main canvas 4 upon which the artist would be working.

A lower aluminum channel 5 is adjustably fastened to vertical standard 2 by means of a stout wing nut 6 upon an appropriate bolt. channel 5 is positioned with the web thereof flat against standard 2 so that canvas 4 may be suitably supported by merely laying the lower edge of the same upon the channel. The channel thus constitutes a convenient means for attaching the auxiliary holder of this invention to the easel. One of the forward-projecting parts of the channel is employed.

Figure 3:
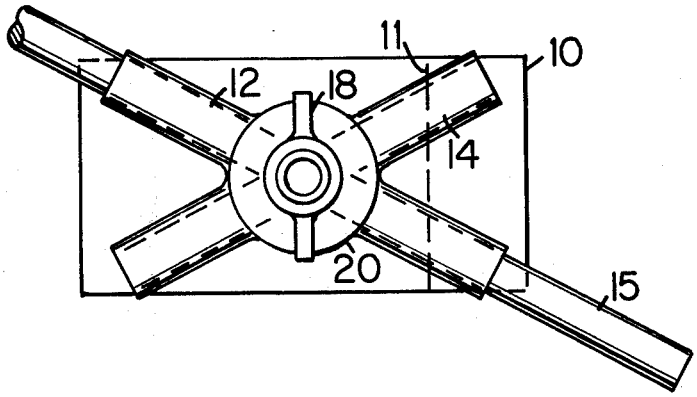
FIG. 3 is a fragmentary view in bottom plan of the fitment that fastens to the easel.

In the invention proper, fitment 10 is essentially a rectangular member, as shown in the underneath view of FIG. 3. The fitment has a first aperture 11, having the shape of a large slice out of the middle of the rectangular member and an opening of the order of 3 mm. This aperture is for the purpose of fastening the fitment onto the lower forward-projecting part of channel 5. The fit is retained by friction. Since the lever arm of the attachment is large, sufficient friction occurs even though the fit of aperture 11 upon the channel is loose. A torsional force is involved.

As best shown in FIG. 3, the under side of fitment 10 preferably has a second aperture 12. The whole structure of the fitment may be fabricated, typically cast, or iron, steel, brass, pot metal, or a metal-like plastic, such as Delrin, an acetal homopolymer that is available from du Pont. Or, the fitment may be fabricated of flat pieces of partial thickness, a pair of tubes, and a threaded boss, that are formed into a unified structure by soldering, brazing or welding.

Although one second aperture 12 is sufficient to provide an operative attachment device, it is preferred that a second one also be provided, as shown at 14. The two normally disposed at an angle, such as 45°.

A first elongated member 15 may be a metal rod 40 cm long and 6 mm in diameter. In use, this is passed through either of the second apertures 12 or 14. Noting that FIG. 3 shows the under side of the fitment, member 15 is shown in aperture 12 to provide a position of sketch 16 either in front of canvas 4 at the left, or at the rear of the canvas at the right. When member 15 is in aperture 14 sketch 16 will be in front of the canvas at the right, as shown in FIG. 1, or to the rear of the canvas at the left. Usually, the positions in front of the artist's canvas will be preferred by him. Of course, apertures 12 and 14 may be altered in inclination when the fitment is fabricated to give any desired special positioning of the sketch.

First member 15 is secured to fitment 10 by first clamping means 18. The latter is conveniently a wing nut having an integral threaded shank 19. The shank threads into a threaded hole in boss 20, which hole is located in the fitment structure at the intersection of the two second apertures 12 and 14, or at an equivalent location. Thus, member 15 can be clamped in either of the two second apertures regardless of which one it is in.

First elongated member 15 has a third aperture 21 within a tubing 22, which is disposed at an angle to the axis of that elongated member, normally a right angle and normally at one extremity of the member. Tubing 22 would typically be soldered, brazed or welded to the end of member 15. This tubing is provided with second clampinng means 23, such as a wing nut having an integral threaded shank 24. The shank threads into a threaded hole in boss 25, which hole enters into third aperture 21.

Figure 2:
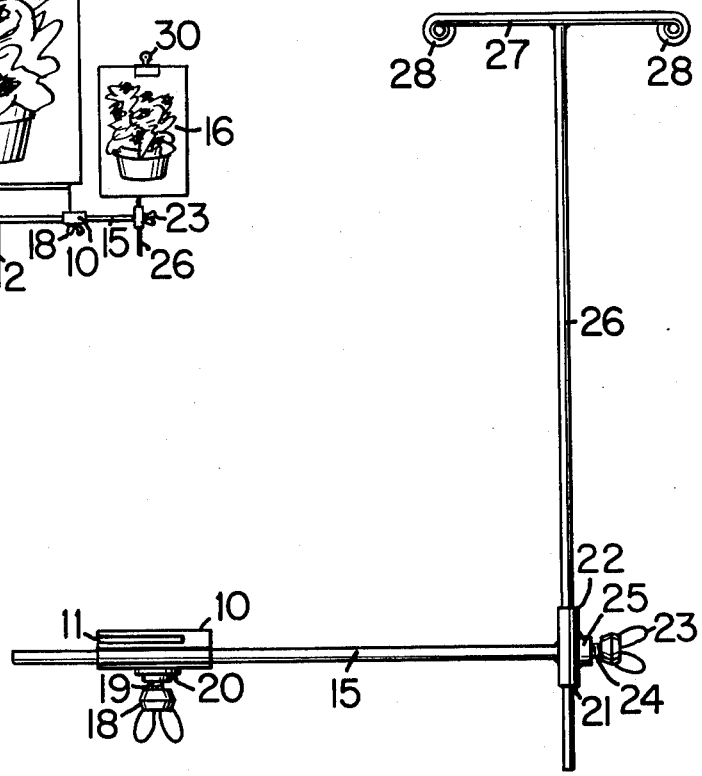
FIG. 2 shows an assembled view in front elevation of the attachment alone.

Second elongated member 26 may also be a metal rod 50 cm long and 6 mm in diameter. In use it is passed through third aperture 21, typically with the major portion of the length up-standing, as shown in FIG. 2. It may be clamped at any point along its length by second clamping means 23.

It will be recognized that any angle to the vertical desired for second member 26 may be set by holding that member as desired and then fastening first clamping means 18. Normally, an inclination leaning backward at the top of member 26 is chosen. This allows a book or sketch to lie against this member to fix its position and also to allow convenient viewing by the artist, whose eye level would normally be above the sketch.

In order to conveniently hold sketch 16, or equivalent, third elongated member 27 is attached to the (upper) extremity of second elongated member 26, by means of soldering, brazing or welding. The third member may have a length of 17 cm and a diameter of 4 mm. Curved ends 28 may be provided to prevent tearing a sketch or an equivalent. The outer radius of the curved ends may be 1.5 cm.

If the sketch or equivalent is contained in a top spiral-bound book or equivalent this may be merely draped over third member 27. Some of the pages thus lie in front of the member and some lie behind it.

If the sketch is a single page, or is on a piece of cardboard or the like, then a known spring clamp 30 may be used to clamp the sketch to the member. This is shown in FIG. 1. A suitable clamp may be the Boston clip No. 4, available from the Hunt Mfg. Co., Statesville, N.C., which has a horizontal length of 7.5 cm.

This clamp has an open upper internal portion that fits upon the third member and also abutting lower smooth jaws that securely fasten anything flat, like a sketch or piece of cardboard.

Certain modifications are possible to accommodate differing conditions of use.

For other types of easels first aperture 11 may have a greater opening, or a spring or clamping means provided, such as 18 that is employed in connection with member 15.

While cylindrical rods have been disclosed to allow orientation of members 15 and 26 over a wide range of relative positions, one or both of these rods may be square, with one or more of apertures 12, 14 or 21 also square. The relation then becomes fixed.

Because there is free space around sketch 16 the extent of the sketch is relatively unlimited. This is opposite to the situation with the prior art, where, when the sketch holder is positioned above the canvas the extent of the sketch must be limited in height.

While not usual, all of the elements of the holder may be fabricated of a metal-like plastic, such as has been previously mentioned.

The convenience of the auxiliary holder of this invention is very great. Any kind of structure that might otherwise extend down to the floor is found to be inconvenient to the artist.

I claim:

1. In combination with an artist's easel (1) having a lower horizontal member (5), a sketch holder, comprising;

a. a fitment (10) having a horizontal slit first aperture (11)

to engage said lower horizontal member (5)

and a second aperture (12) having first clamping means (18), b. a first horizontal elongated member (15) having an axis and being disposed within said second aperture, clampable by said first clamping means, and having a third aperture (21) at an angle to the axis of said first elongated member at one extremity thereof, said third aperture having second clamping means (23), c. a second vertical elongated member (26), being disposed within said third aperture and clampable by said second clamping means, and d. a third horizontal elongated member (27) affixed to the top extremity of said second elongated member at essentially a right angle, whereby a substantially planar sketch can be supported against said second and third elongated members at a selectable distance and inclination to said easel.

2. The holder of claim 1 which additionally includes;

a. a second second aperture (14) horizontally coplanar with and lying at an angle less than a right-angle to the first said second aperture, whereby said first elongated member (15) may be selectively inserted in either of the second apertures.

3. The holder of claim 1, in which;

a. said narrow slit extends within the major portion of the area of said fitment (10).

4. The holder of claim 1, in which;

a. the angle of said third aperture (21) to the axis of said first elongated member is a right-angle.

5. The holder of claim 1, in which;

a. said first, second and third elongated members are rods.

6. The holder of claim 5, in which;

a. the said rods are cylindrical rods.

7. The holder of claim 1, which additionally includes;

a. a separable clamp (30), which secures said substantially planar object to said third elongated member.

8. The holder of claim 1, in which;

a. said first (18) and second (23) clamping means are hand-operable threaded elements.

9. The holder of claim 1, in which;

a. said third elongated member (27) is straight and includes curved portions (28) only at each extremity thereof.

* * * * *